United States Patent [19]

Ivin et al.

[11] 4,142,671

[45] Mar. 6, 1979

[54] ROTOR OF CENTRIFUGAL SEPARATOR

[76] Inventors: Jury F. Ivin, ulitsa Kosareva, 15, kv. 62; Boris P. Shevelin, ulitsa Bardina, 40, korpus 1, kv. 209, both of Sverdlovsk; Vasily I. Sokolov, Kutuzovsky prospekt, 2, kv. 181, Moscow; Arkady N. Levischev, ulitsa Griboedova, 30, kv. 21, Sverdlovsk, all of U.S.S.R.

[21] Appl. No.: 905,033

[22] Filed: May 9, 1978

[30] Foreign Application Priority Data

May 11, 1977 [SU] U.S.S.R. ..... 2493957[I]

[51] Int. Cl.[2] ..... B04B 1/08

[52] U.S. Cl. ..... 233/29

[58] Field of Search ..... 233/27, 28, 29, 34, 233/35, 39, 40, 41

[56] References Cited

U.S. PATENT DOCUMENTS

| | | | |
|---|---|---|---|
| 1,861,896 | 6/1932 | Ayers | 233/29 |
| 2,808,201 | 10/1957 | Mayeux | 233/28 |
| 3,187,998 | 6/1965 | Madany | 233/29 X |
| 3,409,521 | 11/1968 | Sharples | 233/29 X |

FOREIGN PATENT DOCUMENTS

| | | | |
|---|---|---|---|
| 498035 | 5/1976 | U.S.S.R. | 233/29 |

*Primary Examiner*—George H. Krizmanich

*Attorney, Agent, or Firm*—Haseltine, Lake & Waters

[57] ABSTRACT

Each one of the plates made as a truncated cone, of which the separator rotor pack is assembled, is provided with radial projections over the entire circumference of the plate outer flange. The plates are arranged in the pack one on top of the other such that said projections are matched over the pack generatrices. The shape and dimensions of said projections are such as to ensure local overlapping of the axial gap between adjacent plates. Provided between the projections are recesses which, taken together, form a group of channels running parallel with the separator rotor axis and designed for the slowed-down passage of suspension flows being separated, this serving to preclude the washout of the precipitate sliding off the plates into the slime space.

3 Claims, 12 Drawing Figures

ROTOR OF CENTRIFUGAL SEPARATOR

The present invention relates to equipment for separating liquid suspensions or emulsions, such as centrifugal separators and, more particularly, it relates to rotor of the latter.

The herein disclosed rotor of a centrifugal separator may find application in centrifugal separators used in chemical and food industry, metallurgy, mechanical engineering, medicinal and other industries.

Known in the art is a rotor for a centrifugal separator for separating liquid suspensions and emulsions (cf. U.S.S.R. Inventor's Certificate No. 474,183, and Offenlegungsschrift No. 2,512,298, FRG), regarded as prototype by the present inventors, comprising means for delivering a liquid to be separated to a pack of separating plates, means for discharging the obtained products of separation a central rotary drum, a pack of separating plates mainly with vertical pivot axis placed axially in said drum, each of said plates being made as fruncated cone having inner and outer flanges; radial cleats extending from the inner flange to the outer flange projections serving to divide one plate from the other adjoining to ensure a gap between plates greater than the height of said cleats.

The liquid suspension or emulsion to be separated is supplied via means for its delivery to a space defined by the walls of the center drum and the surface of the outer flanges, in which drum the liquid suspension or emulsion is partly separated. The partly separated liquid suspension or partly separated emulsion from said space is supplied to a space between the plates. In said space, during the time the partly separated liquid suspension or partly separated emulsion moves from the plate of the greatest diameter to the plate of the smallest diameter, there takes place a deposition of precipitate particles, in the case of separating a liquid suspension, or of liquid particles such as heavy liquid, in the case of separating an emulsion, onto the inner plate surface. The flow of partly separated liquid suspension or partly separated emulsion in the space between the plates is distributed such that the major part (80 to 90 percent) of the flow passes in the space portion between the cleats while in the circular portion of the space defined by the inner plate surface and the top surface of the cleats there forms a stagnant zone featuring a very slight movement of the partly separated liquid suspension or partly separated emulsion. The precipitate particles deposited in the space between the plates in case a liquid suspension is separated, or heavy liquid particles deposited in case a heavy liquid-containing emulsion is separated, form on the inner plate surface in the zone of slight movement of the partly separated liquid suspension or partly separated emulsion a precipitate layer in the case of separating a liquid suspension, or a heavy liquid layer in the case of separating an emulsion.

The precipitate or heavy liquid layer thus formed is moved continuously over the inner surface of the plate under the effect of forces caused by the difference in the density of particles of precipitate and separated liquid in the case of separating a liquid suspension, or by the difference in the density of heavy and light liquid in the case of separating an emulsion, in the direction from the central portion of the plate to the periphery thereof. The precipitate layer in the case of separating a liquid suspension, or the heavy liquid layer in the case of separating an emulsion, is supplied from the plate periphery to the space defined by the walls of the central drum and the surface of the outer flanges of the plates. From said space, the precipitate or heavy liquid is discharged intermittently or continuously via the means for discharging the precipitate when separating a liquid suspension or means for discharging the heavy liquid when separating an emulsion. From the space between the plates, the separated liquid in the case of separating a liquid suspension, or the light liquid in the case of separating an emulsion, is supplied to the means for the removal of separated liquid when separating a liquid suspension or for the removal of light liquid when separating an emulsion.

A proper selection of the length of the cleats on the plates, namely, increasing their length with the distance from the plate to the means for delivering a liquid suspension or emulsion to be separated, helps balance the charging of the space between the plates with partly separated liquid suspension or partly separated emulsion over the entire length of the pack of plates made as truncated cones.

Said rotor has two main disadvantages affecting considerably the separation quality and efficiency of the separators.

The flow of partly separated liquid suspension moving in the space defined by the walls of the central drum and the pack of plates, acts to wash out the layer of precipitate supplied to said space from the plate periphery, said layer being formed in the space between the plates on the plate inner surface, and partial re-involvement of the precipitate particles after the washout of the layer into the flow of partly separated liquid suspension supplied from said space into the space between the plates upon separating a liquid suspension.

When separating an emulsion containing particles of heavy liquid, said disadvantage manifests itself in the following manner: the flow of partly separated emulsion moving in the space defined by the walls of the central drum and the surface of the outer flanges of the plates acts to wash out a jet of heavy liquid supplied to said space from the plate periphery and formed of the heavy liquid layer moving from the central portion of the plate to the periphery of the latter in the space between the plates. After the washout of said jet, part of the heavy liquid is re-involved in the flow of partly separated emulsion supplied from said space to the space between the plates for further separation.

In the circular space between the plates, defined by the central portion of the plates and the ends of cleats nearest to the central portions of the plates, there occurs no forking of the flow of partly separated liquid suspension or partly separated emulsion with the formation of a stagnant zone featuring a slight movement of said suspension or emulsion. As a result, a series of phenomena are observed in said space affecting the separator efficiency, said phenomena being absent from the remaining portion of the space between each pair of plates, defined by the cleat ends. Such phenomena include: interaction upon countercurrent movement of the partly separated liquid suspension and precipitate layer in the case of separating a liquid suspension, and interaction upon counter current movement of the partly separated emulsion and heavy liquid layer in the case of separating an emulsion containing heavy liquid particles; considerable gradient of velocities of the partly separated liquid suspension near the surface of the precipitate layer in the case of separating a liquid suspension, and considerable gradient of velocities of the partly separated emulsion near the surface of the heavy liquid layer in the case of separating an emulsion containing heavy liquid particles.

Known in the art is a centrifugal separator rotor wherein the first one of the foregoing disadvantages is partly eliminated. For example, there is known a rotor (F.R.G. Pat. No. 1,598,204) featuring a reduced washout by the flow of partly separated liquid suspension movable in the space defined by the walls of the central drum and the surface of the outer flanges of the plates, the layer of precipitate supplied to said space from the plate periphery, said layer being formed in the space between the plates on the inner plate surface, and, consequently, a reduced re-involvement of precipitate particles into the flow of partly separated liquid suspension supplied from said space into the space between the plates. This is attained owing to the fact that means for the removal of separated liquid are provided on two sides of the rotor, i.e., the rotor is split in two parts having a common drum and means for delivering liquid suspension.

The design of the latter F.R.G. patent helps reduce by half the velocities, in the direction along the pack of plates, of the flow of partly separated liquid suspension moving in the space defined by the walls of the central drum and the surface of the outer flanges of plates. For most separators, including that according to the last-cited F.R.G. patent, such velocities reach the value of 1–2 m/s whereas the limiting velocities are, for example, 0.3 m/s in the case of aluminium hydroxide, 0.5 m/s in the case of lime, 0.1 m/s in the case of ferric hydroxide. Referred to as the limiting velocities are the velocities of a flow of partly separated liquid suspension or partly separated emulsion at which the washout starts of the precipitate layer or heavy liquid layer, respectively, supplied to the space defined by the walls of the central drum and the surface of the outer flanges of plates. It follows from the afore-cited experimental velocity values that the velocity reduction attained in accordance with the last-cited F.R.G. patent is inadequate for a complete elimination of the disadvantage under consideration.

The application of F.R.G. Pat. No. 1,598,204 to the rotor design according to U.S.S.R. Inventor's Certificate No. 474,183 leads to partial elimination of the second one of the afore-described disadvantages, however, this adds considerably to the complexity of design.

It is an object of the present invention to provide a rotor for a centrifugal separator for separating emulsions, featuring no washout by the flow of partly separated emulsion, moving in a space defined by the walls of the central drum and the surface of the outer flanges of the plates, of a jet of heavy liquid supplied to said space from the plate periphery and formed of a layer of heavy liquid moving from the central portion of the plate to the periphery thereof in the space between the plates and, therefore, featuring no partial re-involvement of the liquid into the flow of partly separated emulsion supplied for separation from said space to the space between the plates.

It is another object of the present invention to provide a rotor of a centrifugal separator, featuring a considerably reduced circular space between the plates, defined by the plate central portion and by the ends of cleats nearest said central portion of the plates shaped as truncated cones.

To attain said and other objects of the present invention, disclosure is made herein of a rotor of a centrifugal separator for separating liquid suspensions and emulsions, comprising a central rotary drum with an essentially vertical rotation axis, a pack of separator plates mounted axially in said drum, each one of said plates being made as a truncated cone and including inner and outer flanges, cleats extending radially from the inner flange to the outer flange and projections dividing adjacent plates in order to provide between them a gap greater than the height of said cleats, the rotor further comprising means for delivering a liquid to be separated to the pack of separator plates and means for discharging the obtained separation products; the disclosed rotor is characterized in that each one of the plates is provided with radial projections mounted essentially uniformly over the circumference of said outer flange of the plate such as to form between adjacent projections recesses open into a space defined by the wall of the central drum and the surface of the plate outer flanges, the shape and dimensions of said radial projections of the plates being such as to ensure overlapping of the entire exial gap between adjacent plates in the region of said radial projections, as a result of which groups of said recesses form channels arranged over the plate pack generatrices parallel with the drum rotation axis.

Such technical solution helps form of said recesses channels featuring a relatively increased cross-sectional area. The flows of suspension being separated, passing through these channels, will have a reduced axial velocity, this helping preclude the breaking by said flows of the resulting precipitate sliding off the plates into the space defined by the walls of the central drum and the surface of the outer flanges of the plates.

The centrifugal rotor design of the present invention helps avoid the washout, by the flow of partly separated liquid suspension or emulsion moving in a space defined by the walls of the central drum and the surface of the outer flanges of the plates, of the layer of precipitate or jet of heavy liquid supplied to said space from the plate periphery. The circular space between the plates, defined by the central portion of the plates and by the ends of cleats nearest said central portion of the plates, is reduced considerably, which helps improve the capacity of the separator equipped with the rotor of the invention as compared with that of generators with prior art rotors by a factor of 1.5–2 without changing the overall dimensions of the drum and the pack of plates while maintaining the same quality of liquid separation or, in case the capacity of the separator with rotor is the same as that of separators with prior art rotors, improve the quality of liquid separation many times over that of separators with prior art rotors.

In accordance with one of the embodiments of the present invention, disclosure is made of a centrifugal separator rotor characterized in that said radial projections of the plates include superposed spacers, the length of the spacers is not less than the greatest depth of a recess measured in a radial direction while the height of projections with spacers is equal to the axial gap between the outer flanges of adjacent plates.

Such technical solution helps find the optimum way of making the radial projections to ensure local overlapping of the axisl gap between adjacent plates.

Another embodiment of the present invention provides for a rotor arrangement wherein said superposed spacers of projections of the plates are formed of the outer ends of said radial cleats.

Such a structural arrangement is most convenient for it enables one to form the required spacer between the plates directly from the ends of the radial cleats.

Still another advantage of the rotor according to the invention consists in a decrease of effect upon the quality of separation caused by variations in the concentration of solid phase particles in liquid suspension and heavy liquid particles in emulsion supplied to the rotor for separation, this resulting in an increased reliability of separator operation under industrial conditions when the concentration of solid phase particles in liquid suspension or heavy liquid particles in emulsion supplied to the rotor for separation may vary considerably.

Yet another advantage of the rotor according to this invention consists in that its design permits of low-cost conversion of prior art separator rotors to operation in accordance with the present invention.

The present invention is further illustrated by the description of specific embodiments thereof and the accompanying drawings in which.

Figure 1:
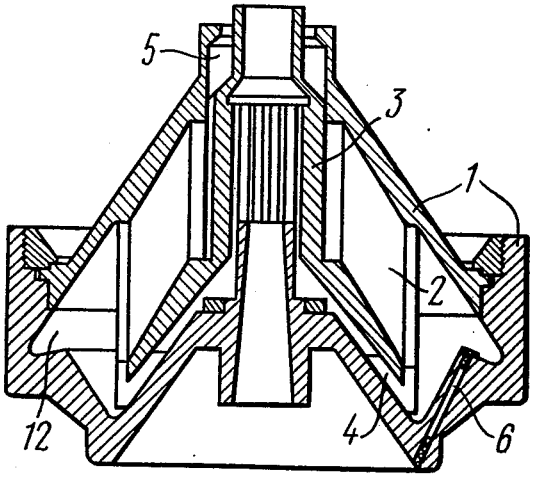
FIG. 1 is a longitudinal sectional view of a rotor of a centrifugal separator for separating liquid suspensions, according to the invention.
Figure 2:
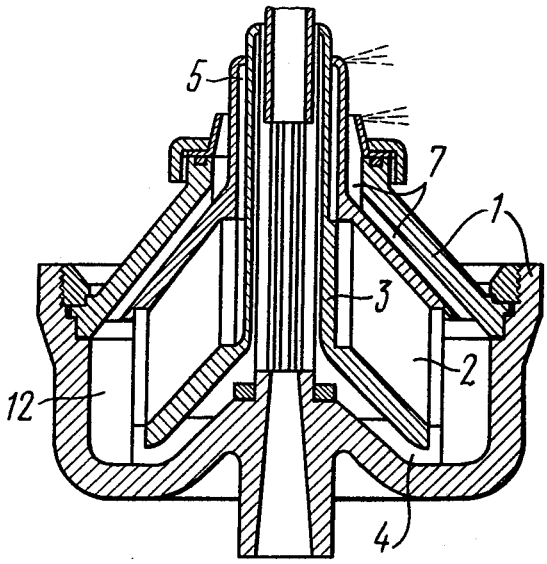
FIG. 2 is a longitudinal sectional view a rotor of a centrifugal separator of the invention for separating emulsions.

Referring now to FIGS. 1 and 2 of the drawings, the herein disclosed rotor of a centrifugal separator for separating liquid suspensions or emulsions is provided with a central rotary drum accommodating a pack of separating plates 2 each of which is made as truncated cones and fixed on a plate holder 3, means 4 for delivering a liquid to be separated, means 5 for the removal of separated liquid when separating a liquid suspension or light liquid in case of separation of emulsion, means 6 for discharging of precipitate in case of separation of liquid suspension and means 7 for the removal of light liquid when separating an emulsion.

Figure 3:
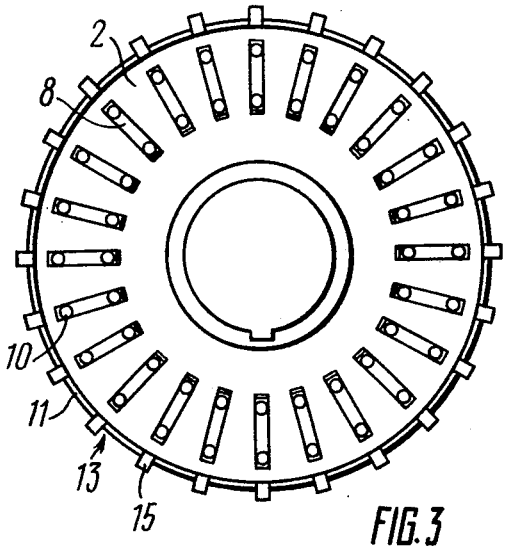
FIG. 3 is a plan view of a plate, according to the invention, closest to means for delivering a liquid suspension or emulsion to be separated to a pack of plates shaped as truncated cones.
Figure 4:
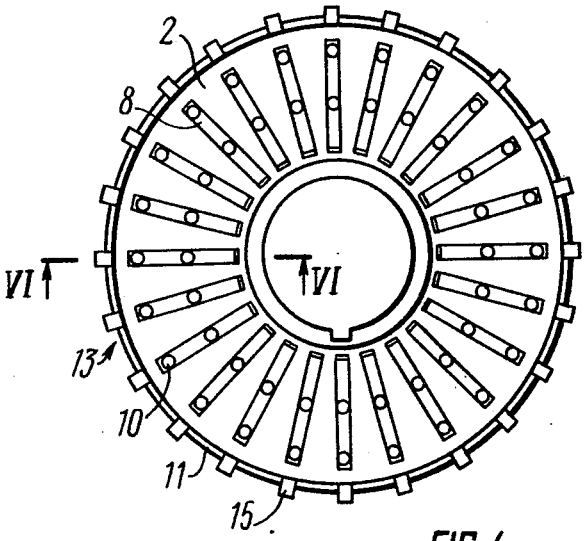
FIG. 4 is a plan view of a plate, according to the invention, removed from means for delivering a liquid suspension or emulsion to be separated to a pack of plates.
Figure 5:
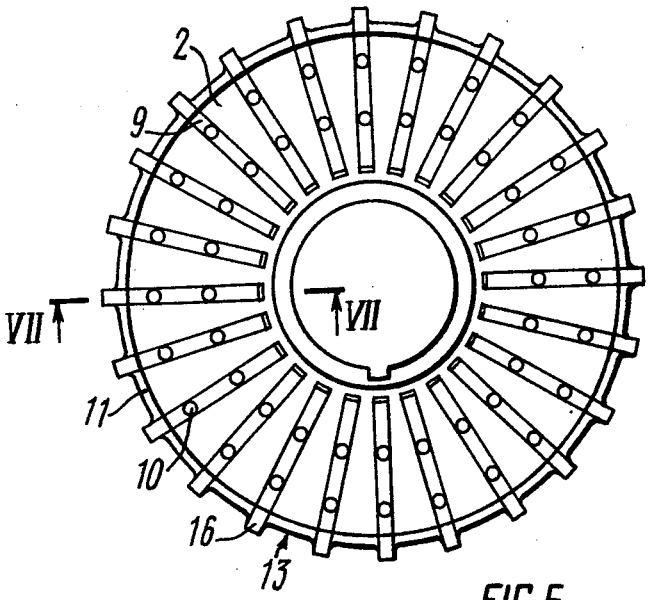
FIG. 5 illustrates an embodiment of the plate, according to the invention.
Figure 7:
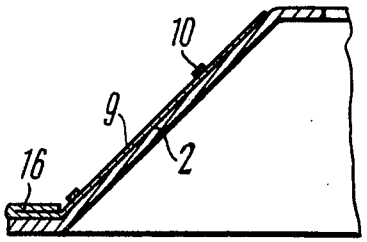
FIG. 7 is a section taken on the line VII—VII of FIG. 5, according to the invention.
Figure 8:
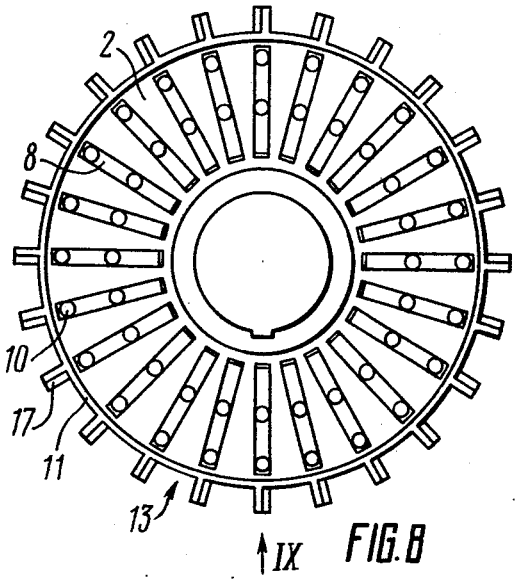
FIG. 8 illustrates an embodiment of the plate made as truncated cone, according to the invention.
Figure 11:
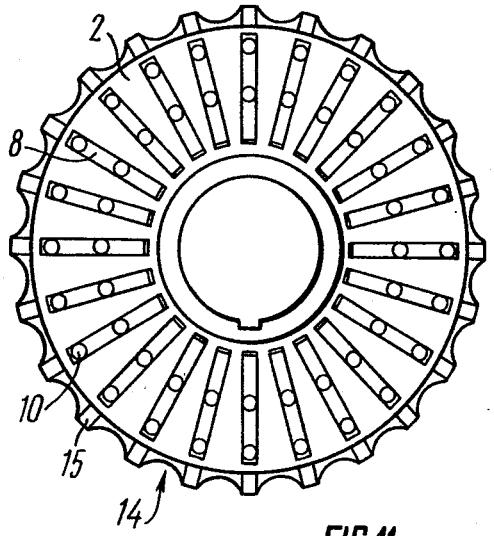
FIG. 11 illustrates an embodiment of the plate, according to the invention.

The plates 2 for the rotor of centrifugal separator for separating a liquid suspension (FIG. 1) and for the rotor of centrifugal separator for separating an emulsion (FIG. 2) are identical of design. Fixed to the plate 2 are radially extending cleats 8 (FIGS. 3, 4, 6, 8, 10, 11, 12) or cleats 9 (FIGS. 5, 7) running from the central portion of the plates 2 towards the periphery thereof. On the cleats 8 and 9 are fixed projections 10 serving to divide adjacent plates. The cleats 8 and 9 are of uniform height which is less than the value of the gap between the adjacent plates 2 by the size of the projections 10. Each single plate 2 has said cleats 8 and 9 of uniform length, while the pack is assembled of plates 2 having cleats 8 and 9 of different length increasing with the distance from the plate 2 to the means 4 for delivering a liquid suspension or emulsion to be separated. For example, the length of the cleats 8 of the plate 2 shown in FIG. 4 is greater than that of the cleats of the plate 2 shown in FIG. 3 since the latter plate is located at a shorter distance from the means 4 for delivering a liquid suspension or emulsion to be separated.

Provided on an outer flange 11 of the plates 2 are recesses 13 (FIGS. 3, 4, 5, 8) and 14 (FIG. 11) open into a space 12 (FIGS. 1, 2, 12) defined by the walls of the central drum 1 and the surface of the outer flanges of plates. In plan view, the shape of said recesses may differ. For example, the recesses 13 (FIGS. 3, 4, 5, 8) are trapezoidal in shape while the recesses 14 (FIG. 11) are semicircular in shape.

Figure 9:
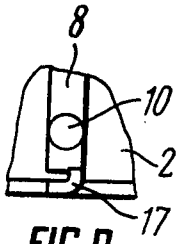
FIG. 9 is a view taken along arrow IV of FIG. 8, according to the invention.
Figure 10:
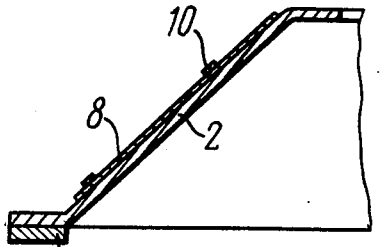
FIG. 10 illustrates an embodiment of a projection with a spacer between recesses in the outer flange of the plate, according to the invention.
Figure 6:
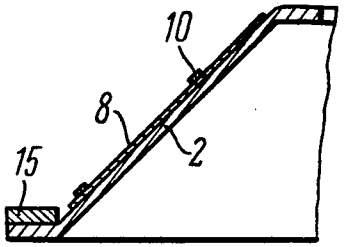
FIG. 6 is a section taken on the line VI—VI of FIG. 4.

Arranged between the recesses 13 (FIGS. 3, 4, 5, 8) and 14 (FIG. 11) on the outer flange 11 of each plate 2 are radially extending superposed spacers 15 (FIGS. 3, 4, 6, 11, 12), or spacers 16 (FIGS. 5, 7), or projections 17 (FIGS. 8, 9), or spacers 18 (FIG. 10), the lengths of said spacers being not less than the greatest depth of the recess 13 (FIGS. 3, 4, 5, 8) or 14 (FIG. 11) measured in a radial direction while their height is equal to the gap between the flanges of adjacent plates 2. Said spacers 15, 16 and projections 17, 18 are arranged in the pack of plates 2 one on top of the other. The projections and spacers may have different shape. For instance, the spacers 15, 18 (FIGS. 3, 4, 6, 10, 11, 12) have the shape of a parallelepiped same as the spacers 16 (FIGS. 5, 7) made by bending the end of the cleat 9, while the projection 17 (FIGS. 8, 9) is L-shaped. The spacers 15 and 16 may be located both on the outer surface of the flange 11 of the plates 2, for example, spacers 15 (FIGS. 3, 4, 6, 11, 12), 16 (FIGS. 5, 7) and projections 17 (FIGS. 8, 9), and on the inner surface of said flange 11, for example, spacers 18 (FIG. 10). It is expedient to assemble the pack of plates having recesses of identical shape.

Figure 12:
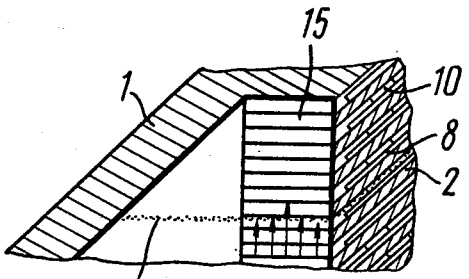
FIG. 12 shows a portion of the pack of plates and a portion of a space defined by the walls of the central drum and the surface of the outer flanges of plates shaped as truncated cones, according to the invention.

The rotor of a centrifugal separator of the present invention operates in the following manner. A liquid suspension or emulsion is supplied to the means 4 for delivering a liquid suspension or emulsion to be separated. Thereupon, the liquid suspension or emulsion is delivered to the recesses such as recesses 13 (FIGS. 3, 4, 5, 8) or 14 (FIG. 11) on the outer flange 11 of the plates 2 where it is partly separated. Acting on the mass of partly separated liquid suspension or partly separated emulsion moving along the pack of plates 2 and participating in the radial movement towards the space between each two pairs of plates 2 is a Coriolis force whose magnitude depends, in particular, upon the mass of partly separated liquid suspension or partly separated emulsion participating in said movement. The reduction of said mass by way of separating the partly separated liquid suspension or partly separated emulsion into flows in the recesses 13 (FIGS. 3, 4, 5, 8) or 14 (FIG. 11) on the outer flanges 11 of the plates 2 helps reduce the magnitude of the Coriolis force and of radially directed resistance force. This results in an increased thickness of the flow of partly separated liquid suspension or partly separated emulsion moving in the space 12 between the walls of the central drum 1 and the surface of the outer flanges of plates 2 and, consequently, brings about a reduction of said flow velocity which becomes less than the limiting velocity. The flow velocity distribution is shown in the velocity diagram in part of the space 12 defined by the walls of the central drum 1 and the surface of the outer flanges of plates 2, as illustrated in FIG. 12 by indicating with arrows the direction and velocity of movement of the partly separated liquid suspension or partly separated emulsion. It is seen from FIG. 12 that almost the entire flow of partly separated liquid suspension or partly separated emulsion moving along the pack of plates 2 in the space 12 defined by the walls of the central drum 1 and the surface of the outer flanges of plates 2 flows in a channel formed in the pack of plates 2 by the matching recesses, say, recesses 13 (FIGS. 3, 4, 5, 8) and projections with superposed spacers, say, projections 15 (FIGS. 3, 4, 6, 11, 12), provided on the outer flange 11 of the plates 2. FIG. 12 further shows with dots the flow of precipitate in the case of separating a liquid suspension, or the flow of heavy liquid in the case of separating an emulsion, along the inner surface of the plate 2 and in said channel.

In addition, the flow of partly separated liquid suspension or partly separated emulsion is acted upon by resistance forces caused by friction against the outer flanges 11 of the plates 2 and against a layer of relatively low-mobile partly separated liquid suspension or partly separated emulsion located in the portion of the space 12 defined by the walls of the central drum 1 and the flow of partly separated liquid suspension or partly separated emulsion moving along the pack of plates 2, as well as by the accompanying vortex formation. These forces cause considerable pressure losses upon movement of the flow of partly separated liquid suspension or partly separated emulsion along the pack of plates 2. The quantity of said losses depends on the velocity of said flow. A reduction of said velocity results in a reduction of said pressure losses and pressure differential between the plates 2 most removed from and closest to the means 4 for delivering a liquid suspension or emulsion to be separated.

From the recesses 13 (FIGS. 3, 4, 5, 8) or 14 (FIG. 11) the partly separated liquid suspension or partly separated emulsion is supplied to the space between the plates 2. In said space, during the time the partly separated liquid suspension or partly separated emulsion moves from the maximum diameter of the plate 2 to its minimum diameter, precipitate particles are deposited in the case of separating a liquid suspension, or heavy liquid particles in the case of separating an emulsion, on the inner surface of the plate 2. The bulk of flow of partly separated liquid suspension or partly separated emulsion flows in the space between the cleats 8 (FIGS. 3, 4, 6, 8, 10, 11, 12) or 9 (FIGS. 5, 7), while in the space defined by the inner and outer surfaces of the plates 2 and the top surface of the cleats 8, 9 there forms a stagnant zone featuring a very slight movement of the partly separated liquid suspension or partly separated emulsion. The precipitate particles in the case of separating a liquid suspension, or heavy liquid particles in the case of separating an emulsion, deposited in the space between the plates 2, form on the inner surface of the plate 2 in the zone of slight movement of the partly separated liquid suspension or partly separated emulsion a layer of precipitate in the former case, or a layer of heavy liquid in the latter case. The thus formed layer of precipitate or heavy liquid is moved in the direction from the central portion of the plate 2 to the periphery thereof under the effect of forces caused by the difference in the density of precipitate particles and separated liquid in the case of separating a liquid suspension, or by the difference in the density of heavy and light liquid in the case of separating an emulsion.

This brings about a considerably reduced interaction upon countercurrent movement of partly separated liquid suspension and precipitate layer in the case of separating a liquid suspension, or of partly separated emulsion and heavy liquid layer in the case of separating a heavy liquid-containing emulsion, as well as about a reduced velocity gradient of the partly separated liquid suspension near the surface of the precipitate layer in the formed case, or a reduced velocity gradient of the partly separated emulsion near the surface of the heavy liquid layer in the latter case.

The afore-mentioned reduction of pressure losses of the flow of partly separated liquid suspension or partly separated emulsion moving along the pack of plates 2 in the space 12 defined by the walls of the central drum 1 and the surface of the outer flanges of plates 2 helps reduce the circular space between the plates 2 defined by the central portion of the plates 2 and the ends of the cleats 8 and 9 nearest said control portion of the plates 2.

From the space between the plates 2, the separated liquid in the case of separating a liquid suspension, or light liquid in the case of separating an emulsion, is supplied to the means 5 for the removal of separated liquid in the case of separating a liquid suspension or for the removal of light liquid in the case of separating an emulsion.

The layer of precipitate in the case of separating a liquid suspension, or layer of heavy liquid in the case of separating an emulsion, formed in the space between the plates 2 and supplied to the space 12 defined by the walls of the central drum 1 and the surface of the outer flanges of plates 2, gets into a flow of partly separated liquid suspension in the former case, or into a flow of partly separated emulsion in the latter case, moving with a velocity less than the limiting velocity of washing out the precipitate layer in the case of separating a liquid suspension, or heavy liquid layer in the case of separating an emulsion. This serves to preclude the washout of the precipitate layer and re-involvement of precipitate particles into the flow of partly separated liquid suspension in the case of separating a liquid suspension, or the washout of the heavy liquid layer and re-involvement of heavy liquid particles into the flow of partly separated emulsion in the case of separating an emulsion, supplied from said space 12 into the space between the plates 2. From said space 12 the precipitate, in the case of separating a liquid suspension, is discharged via means 6 for discharging the precipitate (FIG. 1), while the heavy liquid, in the case of separating an emulsion, is discharged via means 7 (FIG. 2) for the removal of heavy liquid.

The use of the herein disclosed rotor of a centrifugal separator helps increase the separator capacity by a factor of 1.5–2 as compared to the prototype rotor.

What is claimed is:

1. A rotor of a centrifugal separator for separating liquid suspensions and emulsions, comprising: a central rotary drum with an essentially vertical rotation axis; a pack of separator plates placed axially in said drum, each one of said plates being made as a truncated cone and including an inner flange and an outer flange; cleats extending radially from the inner flange to the outer flange; projections dividing adjacent plates from each other in order to provide between them a gap greater than the height of said cleats; means for delivering a liquid to be separated to the pack of separator plates; means for discharging the resulting separation products; each one of said plates made as a truncated cone being provided with radial projections arranged essentially uniformly over the circumference of said outer flange of the plate such as to form between adjacent projections recesses open into a space defined by the walls of the central drum and the surface of the outer flanges of the plates, the shape and dimensions of said radial projections of the plates being such as to ensure overlapping of the entire axial gap between adjacent plates in the region of said radial projections, groups of said recesses forming channels arranged over the generatrices of the pack of plates parallel with the drum rotation axis.

2. A rotor of a centrifugal separator, as claimed in claim 1, wherein said radial projections of the plates include superposed spacers, the spacers length being not less than the greatest depth of a recess measured in a radial direction, while the height of projections with the spacers is equal to the axial gap between the outer flanges of adjacent plates.

3. A rotor of a centrifugal separator, as claimed in claim 1, wherein said superposed spacers of projections of the plates are formed of the outer ends of said radial cleats.

* * * * *